US007779636B2

(12) United States Patent
Buelow et al.

(10) Patent No.: US 7,779,636 B2
(45) Date of Patent: Aug. 24, 2010

(54) LEAN DIRECT INJECTION ATOMIZER FOR GAS TURBINE ENGINES

(75) Inventors: Philip E. O. Buelow, West Des Moines, IA (US); Brandon P. Williams, Riviera Beach, FL (US); David H. Bretz, West Des Moines, IA (US); Michael Spooner, Derby (GB); Caroline Mohamed, Derby (GB); Helen Gill, Nottingham (GB)

(73) Assignee: Delavan Inc, West Des Moines, IA (US)

( * ) Notice: Subject to any disclaimer, the term of this patent is extended or adjusted under 35 U.S.C. 154(b) by 1020 days.

(21) Appl. No.: 11/399,634

(22) Filed: Apr. 6, 2006

(65) Prior Publication Data

US 2006/0248898 A1 Nov. 9, 2006

Related U.S. Application Data

(60) Provisional application No. 60/677,757, filed on May 4, 2005.

(51) Int. Cl.

| | |
|---|---|
| ***F02C 3/24*** | (2006.01) |
| ***F23R 3/14*** | (2006.01) |
| ***F23R 3/34*** | (2006.01) |
| ***F23R 3/36*** | (2006.01) |

(52) U.S. Cl. ..... 60/742; 60/743; 60/748

(58) Field of Classification Search ..... 60/742, 60/743, 748

See application file for complete search history.

(56) References Cited

U.S. PATENT DOCUMENTS

| | | | | |
|---|---|---|---|---|
| 3,899,884 | A | 8/1975 | Ekstedt | |
| 3,980,233 | A | 9/1976 | Simmons et al. | |
| 4,321,794 | A * | 3/1982 | Etheridge | 60/748 |
| 5,224,333 | A | 7/1993 | Bretz et al. | |
| 5,761,907 | A * | 6/1998 | Pelletier et al. | 60/748 |
| 6,272,840 | B1 | 8/2001 | Crocker et al. | |
| 6,354,072 | B1 | 3/2002 | Hura | |
| 6,363,726 | B1 * | 4/2002 | Durbin et al. | 60/748 |
| 6,381,964 | B1 | 5/2002 | Pritchard, Jr. et al. | |
| 6,389,815 | B1 | 5/2002 | Hura et al. | |
| 6,418,726 | B1 * | 7/2002 | Foust et al. | 60/748 |
| 6,688,534 | B2 | 2/2004 | Bretz | |
| 7,540,154 | B2 * | 6/2009 | Tanimura et al. | 60/748 |
| 2002/0011064 | A1 | 1/2002 | Crocker et al. | |
| 2004/0079086 | A1 * | 4/2004 | Smith et al. | 60/748 |
| 2005/0039456 | A1 * | 2/2005 | Hayashi | 60/748 |
| 2006/0021350 | A1 * | 2/2006 | Sanders | 60/743 |

FOREIGN PATENT DOCUMENTS

| | | |
|---|---|---|
| EP | 1 413 830 A2 | 4/2004 |
| EP | 1 413 830 A3 | 7/2006 |

* cited by examiner

*Primary Examiner*—Ted Kim
(74) *Attorney, Agent, or Firm*—Scott D. Wofsy; Edwards Angell Palmer & Dodge LLP

(57) ABSTRACT

A lean direct injection fuel nozzle for a gas turbine is disclosed which includes a radially outer main fuel delivery system including a main inner air swirler defined in part by a main inner air passage having a radially inner wall with a diverging downstream surface, an intermediate air swirler radially inward of the main inner air swirler for providing a cooling air flow along the downstream surface of the radially inner wall of the main inner air passage, and a radially inner pilot fuel delivery system radially inward of the intermediate air swirler.

33 Claims, 13 Drawing Sheets

Predicted Spray Field
2D/Axisymmetric CFD Simulation

Predicted Spray Field
2D/Axisymmetric CFD Simulation

LEAN DIRECT INJECTION ATOMIZER FOR GAS TURBINE ENGINES

CROSS-REFERENCE TO RELATED APPLICATION

This application claims the benefit of priority from U.S. Provisional Patent Application Ser. No. 60/677,757 filed May 4, 2005, the disclosure of which is herein incorporated by reference in its entirety.

BACKGROUND OF THE INVENTION

1. Field of the Invention

The subject invention is directed to gas turbines, and more particularly, to a system for delivering fuel to the combustion chamber of a gas turbine engine by lean direct injection.

2. Background of the Related Art

With increased regulation of pollutants from gas turbine engines, a number of concepts have been developed to reduce engine emissions while improving engine efficiency and overall operability. One such concept is the use of staged combustion. Here, the combustion process is divided into two or more stages or zones, which are generally separated from each other, either radially or axially, but still permitted some measure of interaction. For example, the combustion process may be divided into a pilot combustion stage and a main combustion stage. Each stage is designed to provide a certain range of operability, while maintaining control over the levels of pollutant formation. For low power operation, only the pilot stage is active. For higher power conditions, both the pilot and main stages may be active. In this way, proper fuel-to-air ratios can be controlled for efficient combustion, reduced emissions, and good stability.

In addition to staged combustion, providing a thoroughly blended fuel-air mixture prior to combustion, wherein the fuel-to-air ratio is below the stoichiometric level so that combustion occurs at lean conditions, can significantly reduce engine emissions. Lean burning results in lower flame temperatures than would occur during stoichiometric combustion. Since the production of NOx is a strong function of temperature, a reduced flame temperature results in lower levels of NOx. The concept of directly injecting liquid fuel into the combustion chamber of a gas turbine and enabling rapid mixing with air at lean fuel-to-air ratios is called lean direct injection (LDI).

The prior art is replete with example of LDI systems. For example, U.S. Pat. No. 6,389,815 Hura et al. discloses a lean direct injection system, which utilizes radially staged combustion within a single injector. The pilot fuel delivery stage includes a pressure swirl atomizer that sprays liquid fuel onto a filming surface. The liquid film is then stripped off into droplets by the action of compressor discharge air. The main fuel delivery system includes a series of discrete atomizers that spray fuel radially outward into a swirling cross-flow of air. The main fuel delivery system is staged radially outboard of the pilot fuel delivery system, and operates in the fuel-lean mode. Radial separation as well as an air jet located radially between the two stages achieves separation of the pilot combustion zone and the main combustion zone.

U.S. Pat. No. 6,272,840 Crocker et al. discloses a lean direct injection system, which also utilizes radially staged combustion within a single injector. The pilot fuel delivery is either a simplex air-blast type atomizer or a prefilming air-blast type atomizer, and the main fuel delivery system is a prefilming air-blast type atomizer. Separation of the pilot and main combustion zones is achieved by providing an air splitter between the pilot outer air swirler and the main inner air swirler. The air splitter develops a bifurcated recirculation zone that separates the axially aft flow of the pilot injector from the axially aft flow of the main injector. The bifurcated recirculation zone aerodynamically isolates the pilot flame from the main flame, and ensures that the pilot combustion zone remains on-axis with no central recirculation zone. A converging wall of the pilot air cap, which essentially acts as a flame holder to anchor the flame, defines the air splitter. Acting in this manner, the pilot air cap will likely suffer thermal distress (i.e., oxidation, melting), and require some form of thermal management. In this regard, Crocker et al. disclose the use of small cooling holes in the air cap to improve durability.

European Patent Application EP 1413830 A2 discloses a lean direct injection system, which also utilizes radially staged combustion. In this case, an air splitter with an aft end cone angled radially outward assists in creating a bifurcated recirculation zone. The additional function of the splitter is to prevent the inner main air stream from modulating with combustor pressure fluctuations, thus reducing combustion instability. This air splitter has a larger radial extent than the air splitter disclosed in U.S. Pat. No. 6,272,840 to Crocker et al., and acts as an even larger flame-holder, requiring thermal management to avoid distress.

While the concept of the LDI system is sound, achieving the required levels of performance can be difficult. Lean-burning systems are prone to localized flame extinction and re-ignition. This results in combustion instability that can damage the combustion chamber. Limitations in atomization, vaporization, and fuel-air mixing can result in heterogeneous stoichiometric burning, which yield higher than desired levels of NOx. Also, for these self-contained radially staged LDI systems, control over the level of mixing between the pilot combustion zone and the main combustion zone can be difficult. The negative effects can include reduced margin for lean blowout, and possibly increased levels of smoke.

Accordingly, there is a continuing need in the art to provide a lean direct injection system which can achieve low levels of combustion instability, enhanced atomization quality, increased fuel-air mixing rates, low pollutant formation, low smoke and improved lean blow-out margin.

SUMMARY OF THE INVENTION

The subject invention is directed to a new and useful lean direct injection (LDI) fuel nozzle for a gas turbine engine. The fuel nozzle has a radially outer main fuel delivery system, which includes a main inner air swirler defined in part by a main inner air passage having a radially inner wall with a diverging downstream surface. An intermediate air swirler is located radially inward of the main inner air swirler for providing a cooling air flow along the downstream surface of the radially inner wall of the main inner air passage, and an on-axis pilot fuel delivery system located radially inboard of the intermediate air swirler.

In an embodiment of the subject invention, the main fuel delivery system is of a pre-filming air-blast type and includes a main fuel swirler located radially outward of the main inner air swirler, a main outer air swirler located radially outward of the main fuel swirler, and an outer air cap located radially outward of the main outer air swirler. The location of the leading edge of the radially inner wall of the main inner air passage can vary in accordance with the subject invention. For example, it is envisioned that the radially inner wall of the main inner air passage can extend at least to a terminal edge of the fuel prefilmer. It is also envisioned that the radially inner wall of the main inner air passage can extend beyond the leading edge of the fuel prefilmer, and indeed, beyond the terminal edge of the outer air cap.

In one embodiment of the invention, the pilot fuel delivery system is of a prefilming air-blast type. In this case, the pilot fuel delivery system includes a pilot outer air swirler, a pilot fuel swirler located radially inward of the pilot outer air swirler, and a pilot inner air swirler extending along a central axis of the fuel nozzle. In another embodiment of the invention, the pilot fuel delivery system is of a simplex air-blast type, which includes a pressure swirl atomizer. In this case, the pilot fuel delivery system includes a pilot outer air swirler and a pilot fuel swirler located radially inward of the pilot outer air swirler.

Preferably, the intermediate air swirler includes a set of swirl vanes oriented at an angle sufficient to ensure that the cooling air remains attached to the diverging downstream surface of the radially inner wall of the main inner air passage. Accordingly, the intermediate air swirler includes a set of swirl vanes oriented at an angle of between about 35° to about 60° relative to a central axis of the fuel nozzle. It is envisioned that the swirl vanes of the intermediate air swirler could be oriented to impart swirl in either a clockwise direction or a counter-clockwise direction relative to a central axis of the fuel nozzle. It is also envisioned that the swirl direction of the intermediate air swirler can be either co-rotational or counter-rotational with respect to the swirl direction of the main inner air swirler.

The pilot inner air swirler includes a set of swirl vanes oriented to impart swirl in either a clockwise direction or a counter-clockwise direction relative to a central axis of the fuel nozzle. Similarly, the pilot outer air swirler includes a set of swirl vanes oriented to impart swirl in either a clockwise or a counter-clockwise direction relative to a central axis of the fuel nozzle. It is envisioned that the swirl vanes of the pilot outer air swirler can be configured as axial swirl vanes or radial swirl vanes. It is also envisioned that the swirl direction of the pilot outer air swirler can be either co-rotational or counter-rotational with respect to a swirl direction of the pilot inner air swirler. It is also envisioned that the swirl direction of the pilot fuel swirler can be either co-rotational or counter-rotational with respect to the pilot inner air swirler or the pilot outer air swirler.

The main inner air swirler includes swirl vanes oriented at an angle of between about 20° to about 50° relative to a central axis of the fuel nozzle. The swirl vanes of the main inner air swirler can be oriented to impart swirl in either a clockwise direction or a counter-clockwise direction relative to a central axis of the fuel nozzle. The main outer air swirler includes swirl vanes oriented at an angle of between about 45° to about 65° relative to a central axis of the fuel nozzle. The swirl vanes of the main outer air swirler can be oriented to impart swirl in a clockwise direction or a counter-clockwise direction relative to a central axis of the fuel nozzle. It is envisioned that the swirl vanes of the main outer air swirler can be configured as either axial swirl vanes or radial swirl vanes. It is also envisioned that the swirl direction of the main outer air swirler can be either co-rotational or counter-rotational with respect to a swirl direction of the main inner air swirler. It is also envisioned that the swirl direction of the main fuel swirler can be either co-rotational or counter-rotational with respect to the main inner air swirler or the main outer air swirler.

The subject invention is also directed to a method of injecting fuel into a gas turbine. The method includes the steps of providing an inboard pilot combustion zone, providing a main combustion zone outboard of the pilot combustion zone, and mechanically separating the main combustion zone from the pilot combustion zone in such a manner so as to substantially delay the mixing of hot combustion products from the pilot combustion zone into the main combustion zone. In addition, under certain conditions, for example, when the swirl vanes of the inner and outer pilot air circuits are set at an appropriate swirl angle and the orifice of the pilot air cap is at an appropriate diameter, the method of the subject invention further includes the step of supporting a narrow weak central recirculation zone within the pilot combustion zone.

Preferably, the step of mechanically separating the main combustion zone from the pilot combustion zone includes the step of confining a main inner airflow of a pre-filming air-blast atomizer by providing an inner air passage having a conically expanding radially inner wall, which extends at least to a leading edge of the fuel prefilmer. The method further includes the step of flowing cooling air over the conically expanding radially inner wall of the inner air passage of the pre-filming air-blast atomizer.

The subject invention is also directed to a method of managing airflow through the inner air circuit of a pre-filming air-blast atomizer which includes forming a flow passage of the inner air circuit, in an area downstream from a minimum area location thereof, in such a manner so that there is an increase in pressure from the minimum area location to a downstream exit of the inner air circuit, for air flows that remain attached to the walls of the passage. This method further includes confining the airflow exiting the inner air circuit within a conically expanding annular passage downstream from the minimum area location of the inner air circuit, and sizing the conically expanding annular passage to obtain a desired mass flow rate through the inner air circuit.

The subject invention is also directed to a method of managing airflow through the inner air circuit of a pre-filming air-blast atomizer which includes forming the inner air circuit with a conically expanding annular passage, downstream from an air swirler located within the inner air circuit, in such a manner so that there is an increase in pressure within the inner air circuit from the air swirler to a downstream exit of the conically expanding annular passage, for air flows that remain attached to the walls of the conically expanding annular passage. This method further includes selecting a gap size for the conically expanding annular passage to obtain a desired mass flow rate through the inner air circuit.

These and other aspects of the subject invention will become more readily apparent to those having ordinary skill in the art from the following detailed description of the invention taken in conjunction with the drawings.

BRIEF DESCRIPTION OF THE DRAWINGS

So that those having ordinary skill in the art to which the present invention pertains will more readily understand how to employ the fuel delivery/preparation system of the present invention, embodiments thereof will be described in detail hereinbelow with reference to the drawings, wherein.

DETAILED DESCRIPTION OF THE PREFERRED EMBODIMENTS

Figure 1:
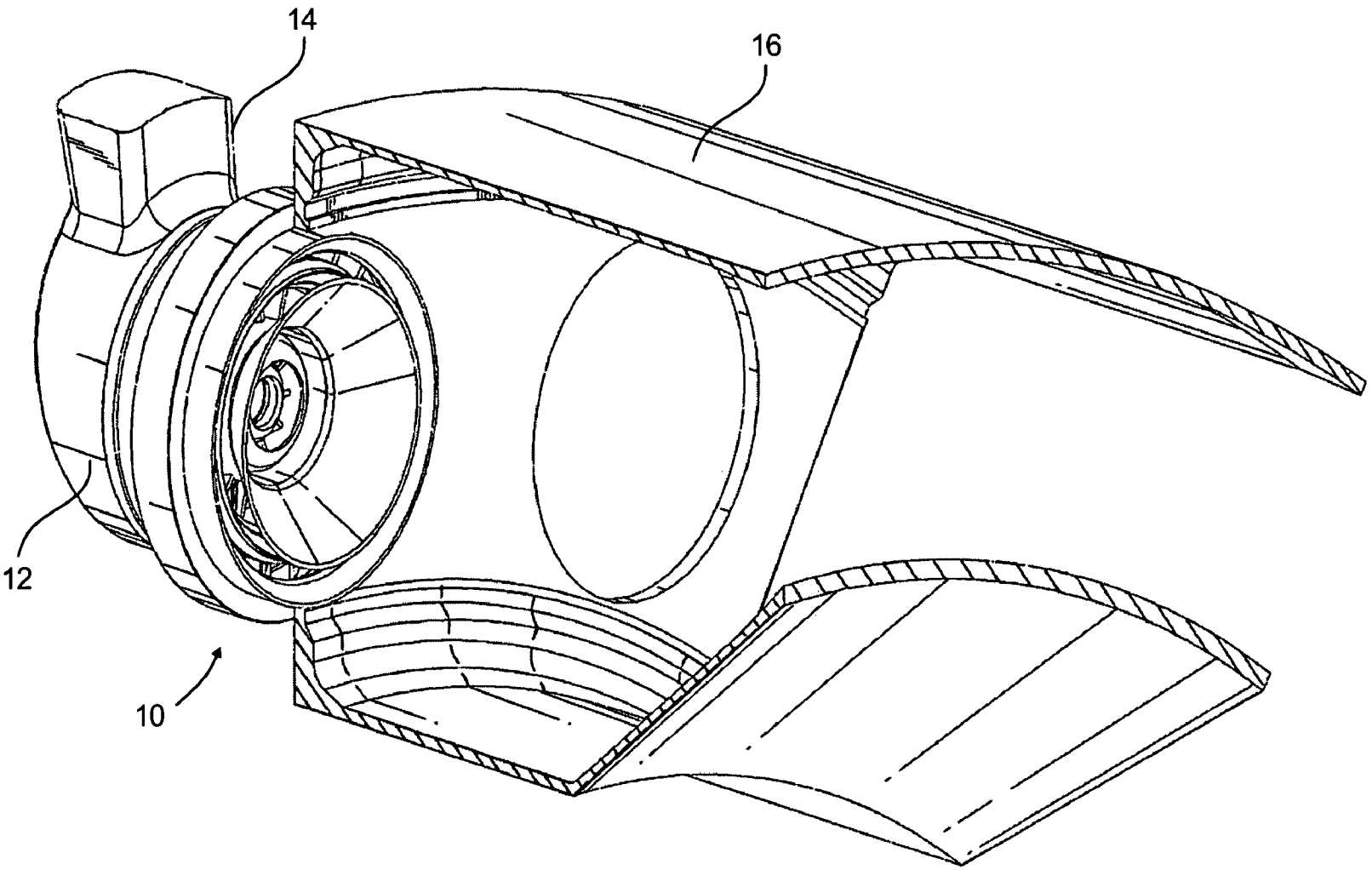
FIG. 1 is a perspective view of a lean direct injection fuel nozzle constructed in accordance with a preferred embodiment of the subject invention and shown within the combustion chamber of a gas turbine engine.

Referring now to the drawings wherein like reference numerals identify similar structural features or aspects of the subject invention, there is illustrated in FIG. 1 a fuel injector for a gas turbine engine, which is constructed in accordance with a preferred embodiment of the subject invention and designated generally by reference numeral 10. Fuel injector 10 is particularly adapted and configured to effectuate two-stage combustion within a gas turbine for enhanced operability and lean combustion for low pollutant emissions.

The fuel injector 10 consists of a pilot fuel delivery system and a main fuel delivery system integrated into a single fuel nozzle. The fuel nozzle is adapted and configured to mechanically and aerodynamically separate the combustion process into two radially staged zones: 1) a pilot combustion zone; and 2) a main combustion zone. During low power operation, only the pilot combustion zone is fueled (see FIG. 8). During high power operation, both the pilot combustion zone and the main combustion zone are fueled (see FIG. 7). The pilot combustion zone provides low power operation as well as good flame stability at high power operation. The main combustion zone operates in a fuel-lean mode for reduced flame temperature and low pollutant formation, particularly nitrogen oxide (NOx), as well as carbon monoxide (CO) and unburned hydrocarbons (UHC). During high power operation, the ignition source for the main fuel-air mixture comes from the pilot combustion zone.

It is understood by those skilled in the art that one way to obtain low NOx pollutant emissions is to prevaporize and premix the liquid fuel and air as completely as possible before combustion. In doing so, the system will burn like a premixed flame at lean conditions producing reduced amounts of NOx, rather than a diffusion flame which tends to burn at stoichiometric (or near stoichiometric) conditions producing large amounts of NOx. The main fuel delivery system of the subject invention is designed to operate in this manner, whereby the main fuel flow atomizes, evaporates and mixes with the main air flow as completely as possible, resulting in a fuel-lean mixture before it burns.

Referring to FIG. 1, fuel injector 10 includes a nozzle body 12, which depends from the lower end of an elongated feed arm 14. In general, nozzle body 12 issues an atomized fuel/air mixture into the combustion chamber 16 of a gas turbine engine. In particular, nozzle body 12 is configured as a multi-staged, lean direct injection (LDI) combustion system, through which 60-70% of the combustion air flows through the injector with the balance of the air used for dome and combustion wall cooling. This effectively reduces pollutant emissions such as nitrogen oxides, carbon monoxides and unburned hydrocarbons.

Figure 2:
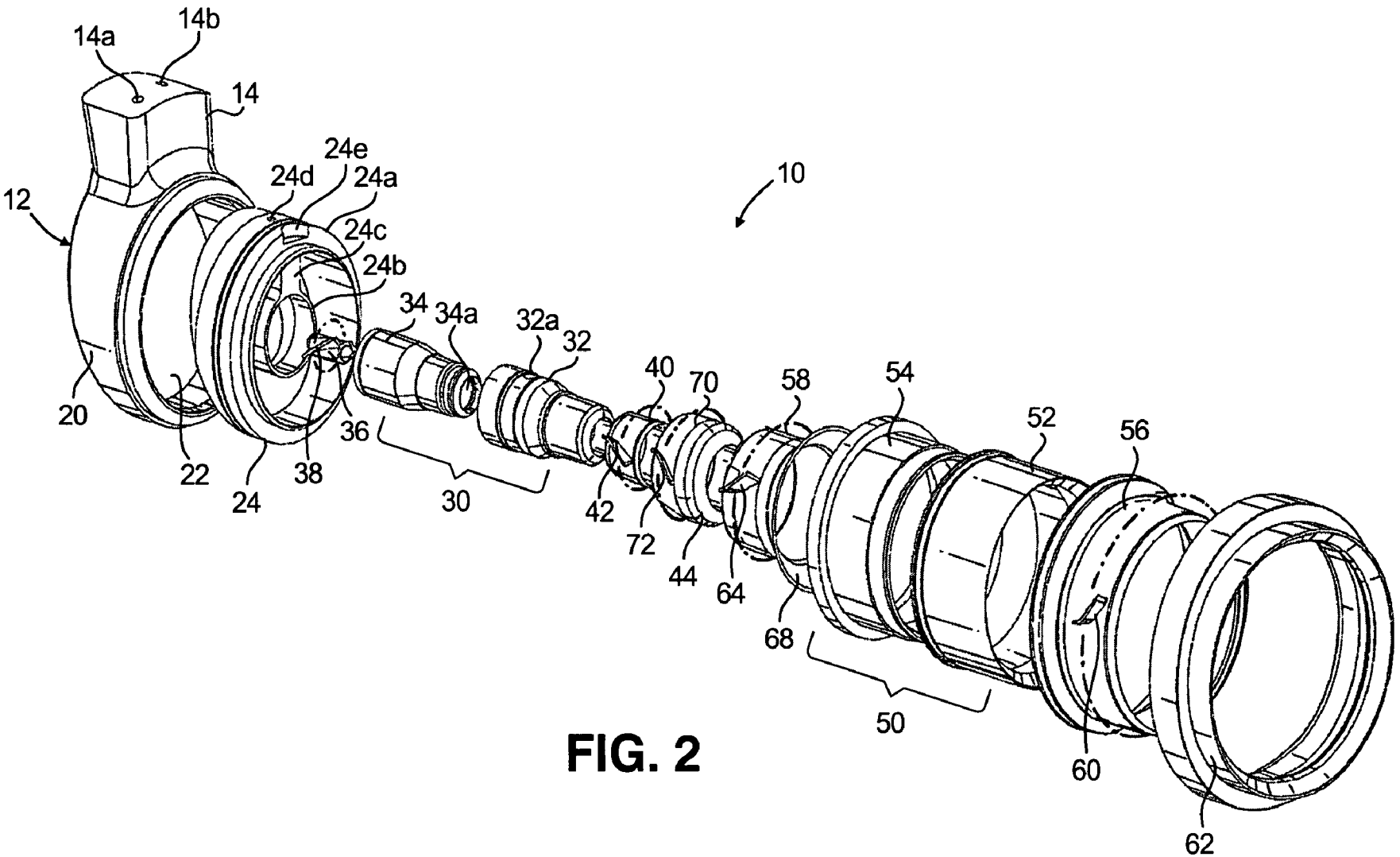
FIG. 2 is an exploded perspective view of the lean direct injection fuel nozzle of FIG. 1, with parts separated for ease of illustration, which includes a pre-filming air-blast type main fuel delivery system and a prefilming air-blast type pilot fuel delivery system.
Figure 3:
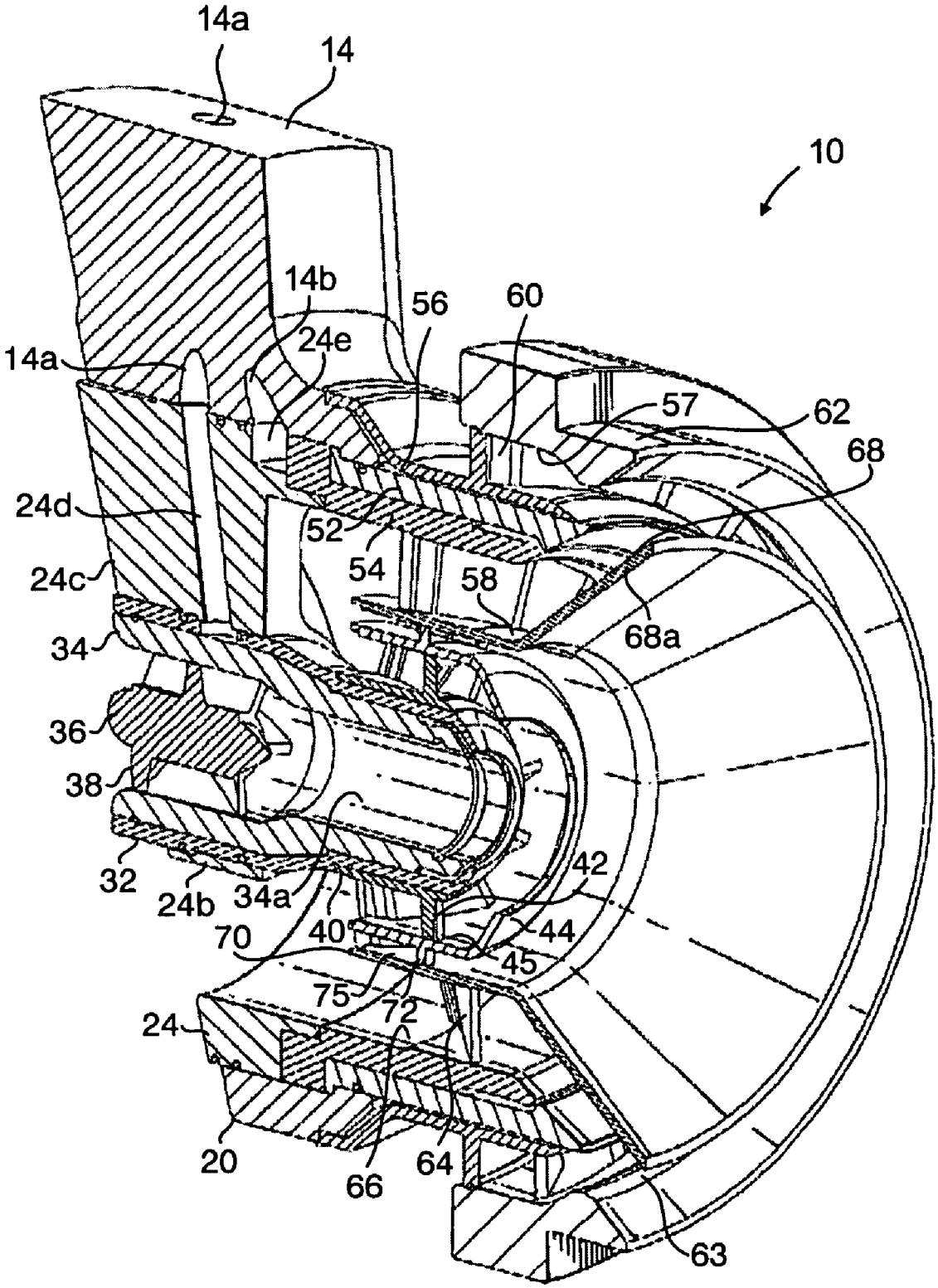
FIG. 3 is a perspective view of the lean direct injection nozzle of FIG. 2, in cross-section, illustrating the components of the pre-filming air-blast type main fuel delivery system and the prefilming air-blast type pilot fuel delivery system.
Figure 4:
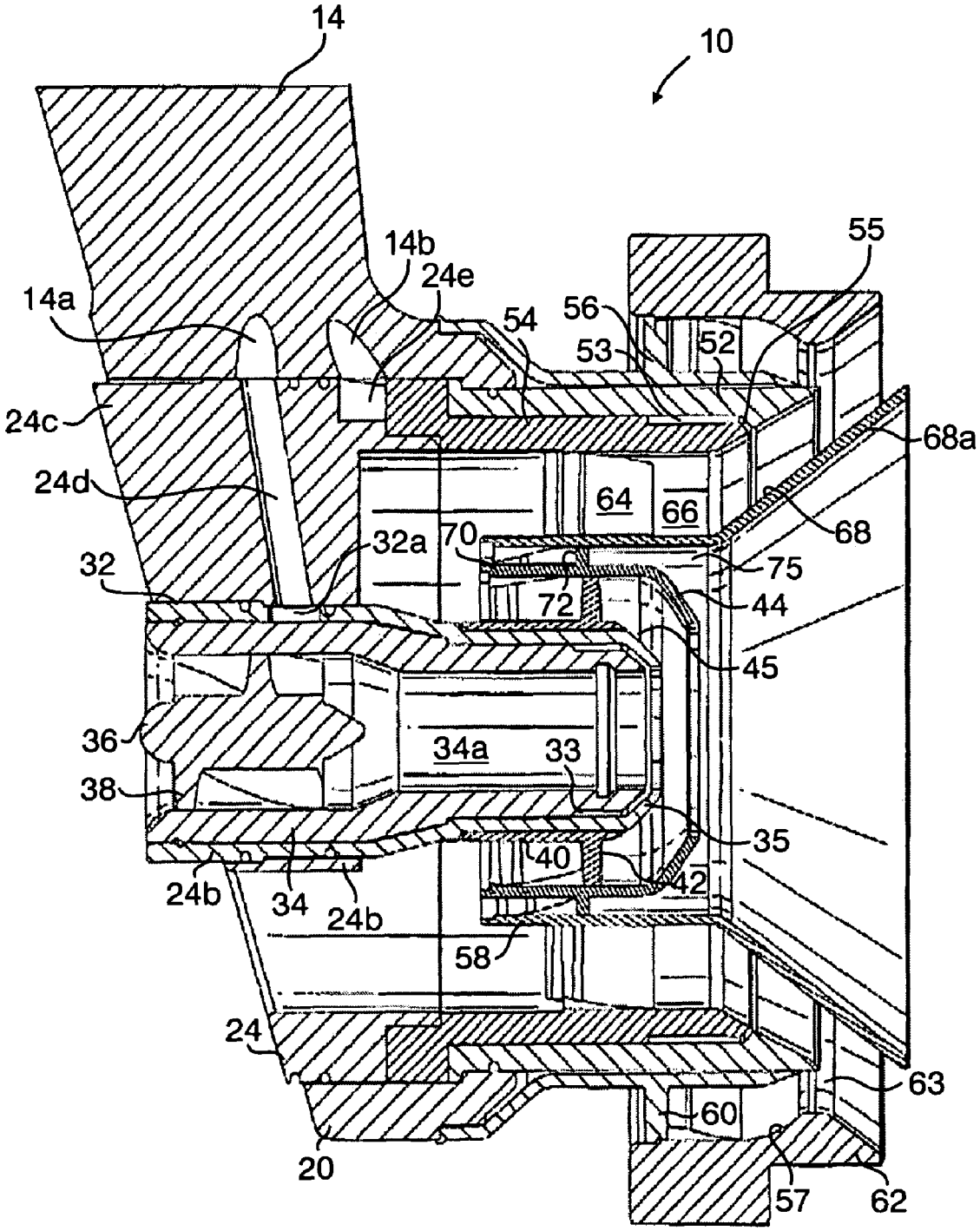
FIG. 4 is a side elevational view of the lean direct injection fuel nozzle of FIGS. 2 and 3, in cross-section, showing the terminal edge of the inner wall of the main inner air passage extending beyond the terminal edge of the outer air cap.

Referring to FIGS. 2 through 4, nozzle body 12 includes an outer body portion 20, which is formed integral with feed arm 14 and defines a cavity 22. Cavity 22 is adapted and configured to receive or otherwise support a primary mounting fixture 24, which forms a base for the coaxially arranged components of fuel injector 10. Mounting fixture 24 includes a radially outer mounting section 24*a*, which mates with the cavity 22 of body portion 20, and a radially inner mounting section 24*b*, which accommodates the pilot fuel swirler 30 described in further detail below. A radial strut 24*c* extends between the outer mounting section 24*a* of fixture 24 and the inner mounting section 24*b* of fixture 24. A pilot fuel conduit 24*d* extends through the radial strut 24*c* for delivering fuel from the pilot fuel passage 14*a* formed in feed arm 14 to the pilot fuel swirler 30, which forms part of the pilot fuel delivery system of fuel injector 10.

The Pilot Fuel Delivery System

The pilot fuel delivery system of fuel injector 10 is illustrated in FIGS. 2 through 8, and is of the pre-filming air-blast atomization type, which includes the pilot fuel swirler 30 that issues a swirling fuel film or sheet for atomization. Pilot fuel swirler 30 includes a radially outer swirler section 32 and a radially inner swirler section 34. The radially outer section 32 includes a pilot fuel port 32*a*, which communicates with the pilot fuel conduit 24*d* in radial strut 24*c* of mounting fixture 24.

A pilot fuel path 33 is formed between the outer swirler section 32 and the inner swirler section 34 of pilot fuel swirler 30. The opposing surfaces of the inner and outer fuel swirler sections 32, 34 are preferably provided with a set of angled spin slots or angled holes (not shown), which impart a swirling motion to the fuel flowing through the pilot fuel path 33

(see FIG. 4). Pilot fuel path 33 feeds into a spin chamber 35, which is formed at the downstream end of the pilot fuel swirler 30. Fuel exits the spin chamber 35 of pilot fuel swirler 30 and interacts with co-flowing inner and outer air streams to atomize and mix the fuel with air, as is typical of a pre-filming air-blast atomizer.

More particularly, a pilot inner air swirler 36 and a pilot outer air swirler 40 bound the pilot fuel swirler 30 to direct high-speed air streams at both sides of the pilot fuel sheet. The radially inner swirler section 34 of pilot fuel swirler 30 defines an axial bore 34*a*, which supports or otherwise accommodates the pilot inner air swirler 36 adjacent an upstream end thereof. The pilot inner air swirler 36 includes a set of circumferentially spaced apart swirl vanes 38 oriented to impart swirl to the compressor discharge air passing through the axial bore 34*a* in either a clockwise direction or a counter-clockwise direction relative to a central axis of the nozzle body 12.

The radially outer swirler section 32 of pilot fuel swirler 30 supports or otherwise accommodates a pilot outer air swirler 40 adjacent a downstream end thereof. The pilot outer air swirler 40 includes a set of circumferentially spaced apart swirl vanes 42 oriented to impart swirl to the compressor discharge air passing through the pilot outer air circuit 45 formed between the outer swirler section 32 and the pilot air cap 44. Here, swirl can be imparted in either a clockwise direction or a counter-clockwise direction relative to a central axis of the nozzle body 12. The swirl vanes 42 of the pilot outer air swirler 40 can be configured as axial swirl vanes or radial swirl vanes.

In an embodiment of the subject invention, the swirl direction of the pilot outer air swirler 40 is co-rotational with respect to the swirl direction of the pilot inner air swirler 36. In another embodiment of the subject invention, the swirl direction of the pilot outer air swirler 40 is counter-rotational with respect to the swirl direction of the pilot inner air swirler 36. In embodiments of the invention, the swirl direction of the pilot fuel swirler 30 can be either co-rotational or counter-rotational with respect to the pilot inner air swirler 36 or the pilot outer air swirler 40.

Figure 5:
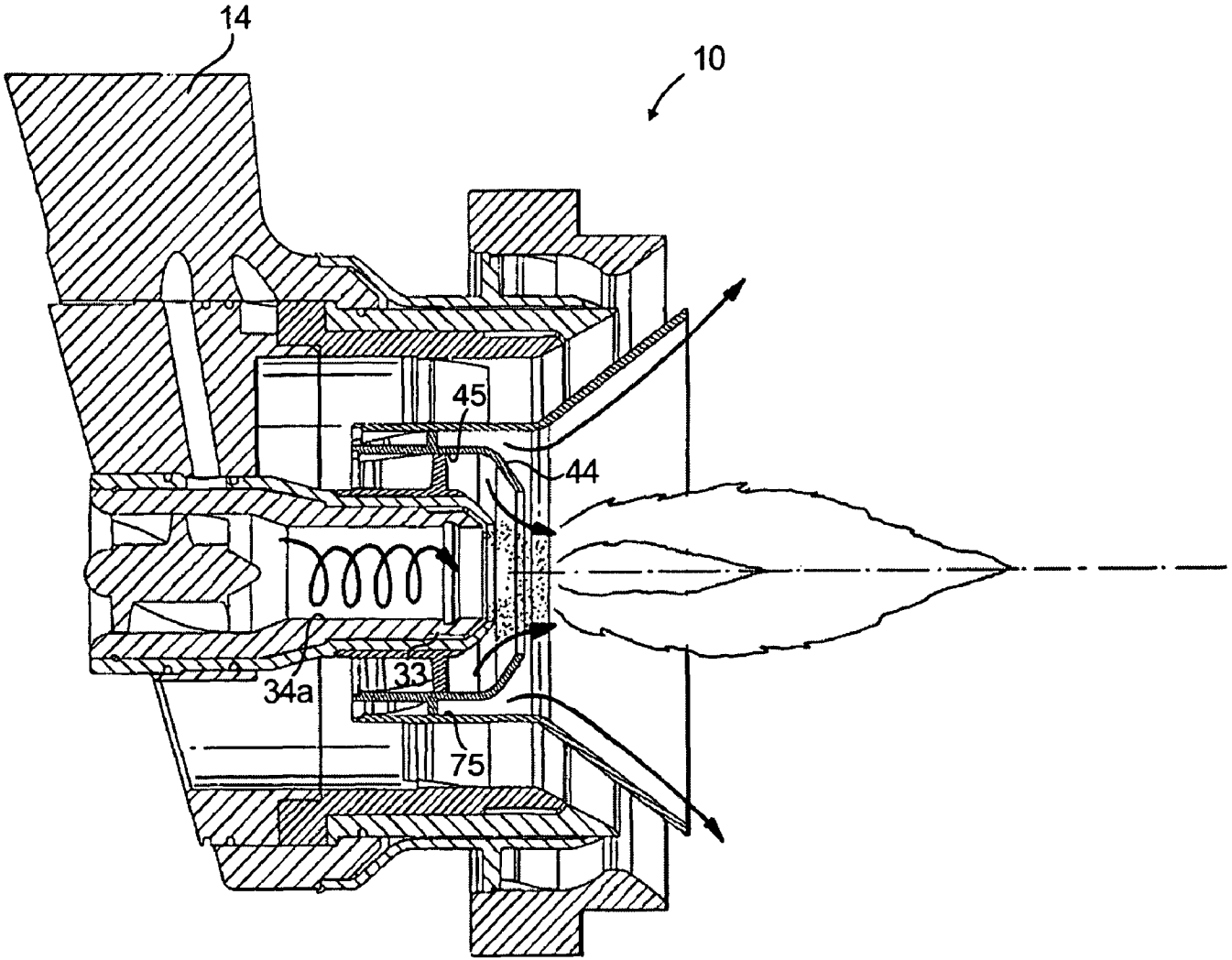
FIG. 5 is a cross-sectional view of the lean direct injection fuel nozzle, as shown in FIG. 4, illustrating the flow paths for air and fuel within the pilot fuel delivery system of the nozzle during low power operation.

The pilot air cap 44 outboard of the pilot outer air swirler 40 serves to confine and direct the outer air stream of the pilot fuel delivery system so that it comes in intimate contact with the liquid fuel sheet issuing from the pilot fuel swirler or pre-filmer, as is typical of airblast atomizers, as shown in FIG. 5. The swirl strength of the inner and outer pilot air swirlers 36, 40 are controlled by the vane angles and the resultant pressure drop taken at the exit points of each of the inner and outer air circuits 34*a*, 45. If the swirl strength is sufficiently low, then the swirling flow field issuing from the pilot fuel delivery system will remain close to the axis of the nozzle 10, even in the presence of a central recirculation zone (see e.g., FIG. 11). This on or near axis pilot fuel zone will help to maintain the separation between the pilot combustion zone and the main combustion zone.

The Main Fuel Delivery System

With continuing reference to FIGS. 2 through 4, the main fuel delivery system of fuel injector 10 is located radially outboard of the pilot fuel delivery system described above. The main fuel delivery system is of the pre-filming air-blast atomization type and is designed in such a manner so that the direction of the air/liquid spray issuing therefrom is generally oriented radially outward. The main fuel delivery system includes a main fuel swirler 50 that issues a swirling fuel film or sheet for atomization. The main fuel swirler 50 includes a radially outer swirler section 52 and a radially inner swirler section 54. A main fuel path 53 is formed between the outer swirler section 52 and the inner swirler section 54 of main fuel swirler 50 (see FIG. 4). The main fuel path 53 communicates with a main fuel passage 24*e* formed in the radially outer mounting section 24*a* of mounting fixture 24, which receives fuel from passage 14*b* in feed arm 14.

The opposing surfaces of the inner and outer main swirler sections 52, 54 are preferably provided with a set of angled spin slots or angles holes (not shown), which impart a swirling motion to the fuel flowing through the main fuel path 53. Main fuel path 53 feeds into a spin chamber 55, which is formed at the downstream end of the main fuel swirler 50. Fuel exiting spin chamber 55 interacts with co-flowing inner and outer air streams to atomize and mix the fuel with air, as is typical of a pre-filming air-blast atomizer.

More particularly, a main radially outer air swirler 56 and a main radially inner air swirler 58 bound the main fuel swirler 50 to direct high-speed air streams at both sides of the main fuel sheet. The main outer air swirler 56 includes a set of circumferentially spaced apart swirl vanes 60. Swirl vanes 60 are oriented or otherwise configured to impart swirl to the compressor discharge air flowing through the main outer air passage 57 formed between radially outer surface of the main outer air swirler 56 and the radially inner surface of the outer air cap 62. Swirl vanes 60 are preferably oriented at angle of greater than or equal to about 45° relative to a central axis of the fuel nozzle and can be oriented or otherwise configured to impart swirl in either a clockwise direction or a counter-clockwise direction relative to a central axis of the nozzle body 12, and they can be configured as axial swirl vanes or radial swirl vanes.

Downstream from the swirl vanes 60 of the main outer air swirler 56 is a converging-diverging passageway or flare 63 formed by the interior surface of the outer air cap 62 (see FIG. 4). This flared region 63 functions to take pressure-drop and a concomitant increase in air velocity at the exit of the fuel prefilmer, so as to enhance atomization (see FIG. 6). The outer air cap 62 confines and directs the air from the main outer air swirler 56 in an accelerated fashion across the liquid fuel film issuing from the main fuel swirler 50.

The main inner air swirler 58 includes a set of circumferentially spaced apart swirl vanes 64. Swirl vanes 64 are oriented or otherwise configured to impart swirl to the compressor discharge air flowing between the radially outer surface of the main inner air swirler 58 and the radially inner surface of the inner section 54 of main fuel swirler 50. Swirl vanes 64 are preferably oriented at angle of about between 20° to about 50° relative to a central axis of nozzle body 12. Vanes 64 can be oriented or otherwise configured to impart swirl in either a clockwise direction or a counter-clockwise direction relative to a central axis of the nozzle body 12.

In an embodiment of the subject invention, the swirl direction of the main outer air swirler 56 is co-rotational with respect to the swirl direction of the main inner air swirler 58. In another embodiment of the subject invention, the swirl direction of the main outer air swirler 56 is counter-rotational with respect to the swirl direction of the main inner air swirler 58.

The main inner air passage 66 is defined between the radially outer surface of the main inner air swirler 58 and the radially inner surface of the inner section 54 of main fuel swirler 50. Although not depicted in the drawings, the outboard wall of the main inner air passage 66 preferably includes structure that serves as a heat shield for the main fuel swirler 50. The main inner air passage 66 has a conically expanding inner wall 68, which is best seen in FIG. 4. The conically expanding inner wall 68 emanates from a location generally downstream from swirl vanes 64, and defines a diverging downstream surface 68*a* located inboard of the main inner air passage 66.

Figure 6:
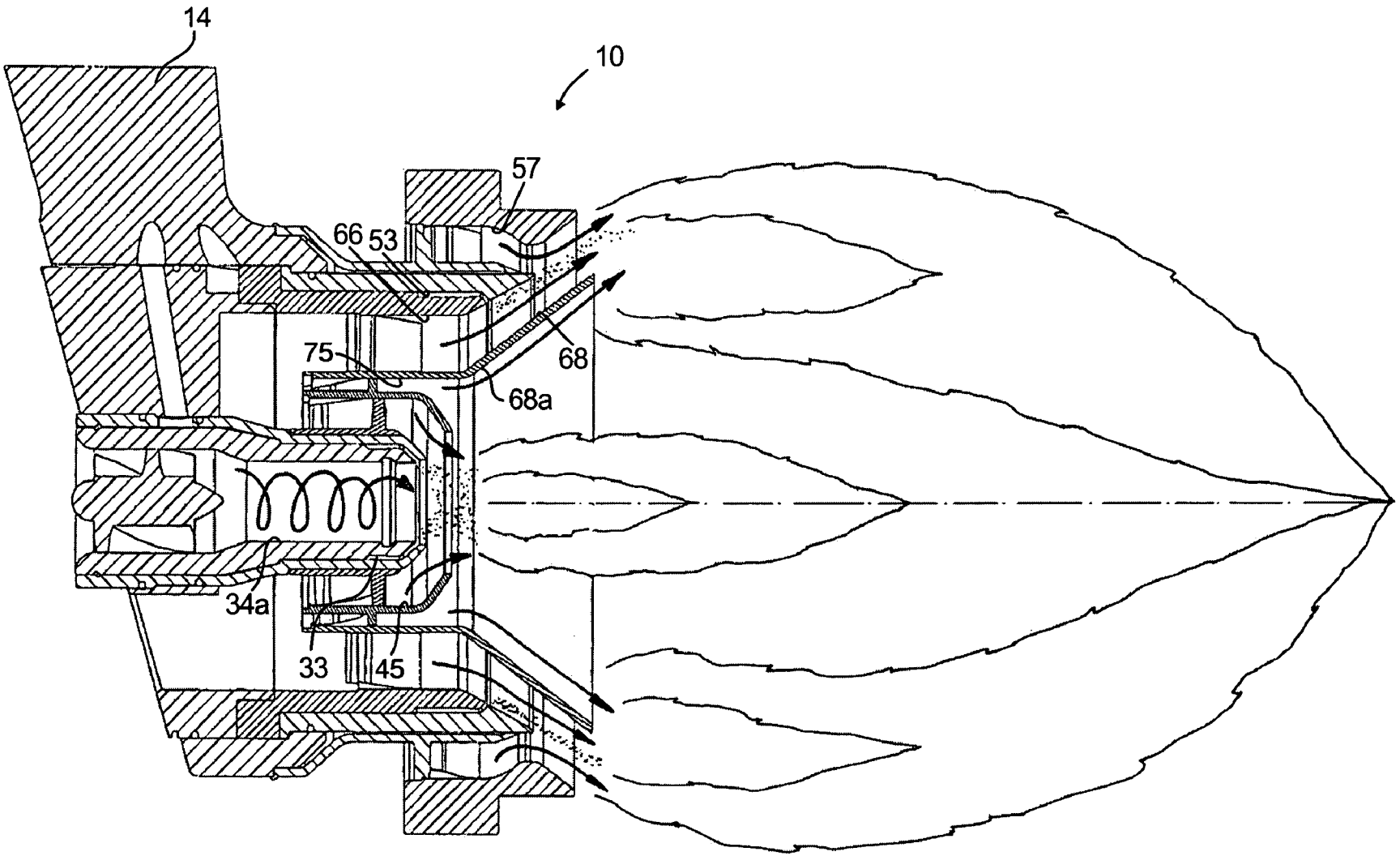
FIG. 6 is a cross-sectional view of the lean direct injection fuel nozzle, as shown in FIG. 4, illustrating the flow paths for air and fuel within the main fuel delivery system and the pilot fuel delivery system of the nozzle during high power operation.

The conically expanding inner wall 68 of the main inner air passage 66 confines the swirling air stream from the main inner air swirler 58 and directs it into close proximity with the fuel sheet issuing from the main fuel swirler 50 for efficient atomization, as shown in FIG. 6. In one embodiment of the invention, the conically expanding inner wall 68 of main inner air passage 66 is configured to take pressure-drop (with a concomitant increase in velocity) across the region in which the swirling inner air interacts with the fuel sheet. At least 48% of the air flowing through fuel injector 10 is directed through the main inner air swirler 58. This provides a cushion of air that assists in the separation of the pilot combustion zone and the main combustion zone and enough air to yield a lean fuel/air mixture in the main combustion zone.

The diverging downstream surface 68*a* of the inner wall 68 of the main inner air passage 66 is exposed to high-temperature combustion products during operation. In the absence of cooling air across the downstream surface 68*a*, the exposure could lead to excessive thermal distress (e.g., oxidation, erosion, melting).

The Intermediate Air Swirler

In accordance with a preferred embodiment of the subject invention, an intermediate air swirler 70 is located between the main inner air swirler 58 of the main fuel delivery system and the pilot outer air swirler 40 of the pilot fuel delivery system. The intermediate air swirler 70 provides a film of cooling air along the downstream surface 68*a* of the inner wall 68 of the main inner air passage 66 to shield downstream surface 68*a* from thermal damage and distress.

Figure 4A:
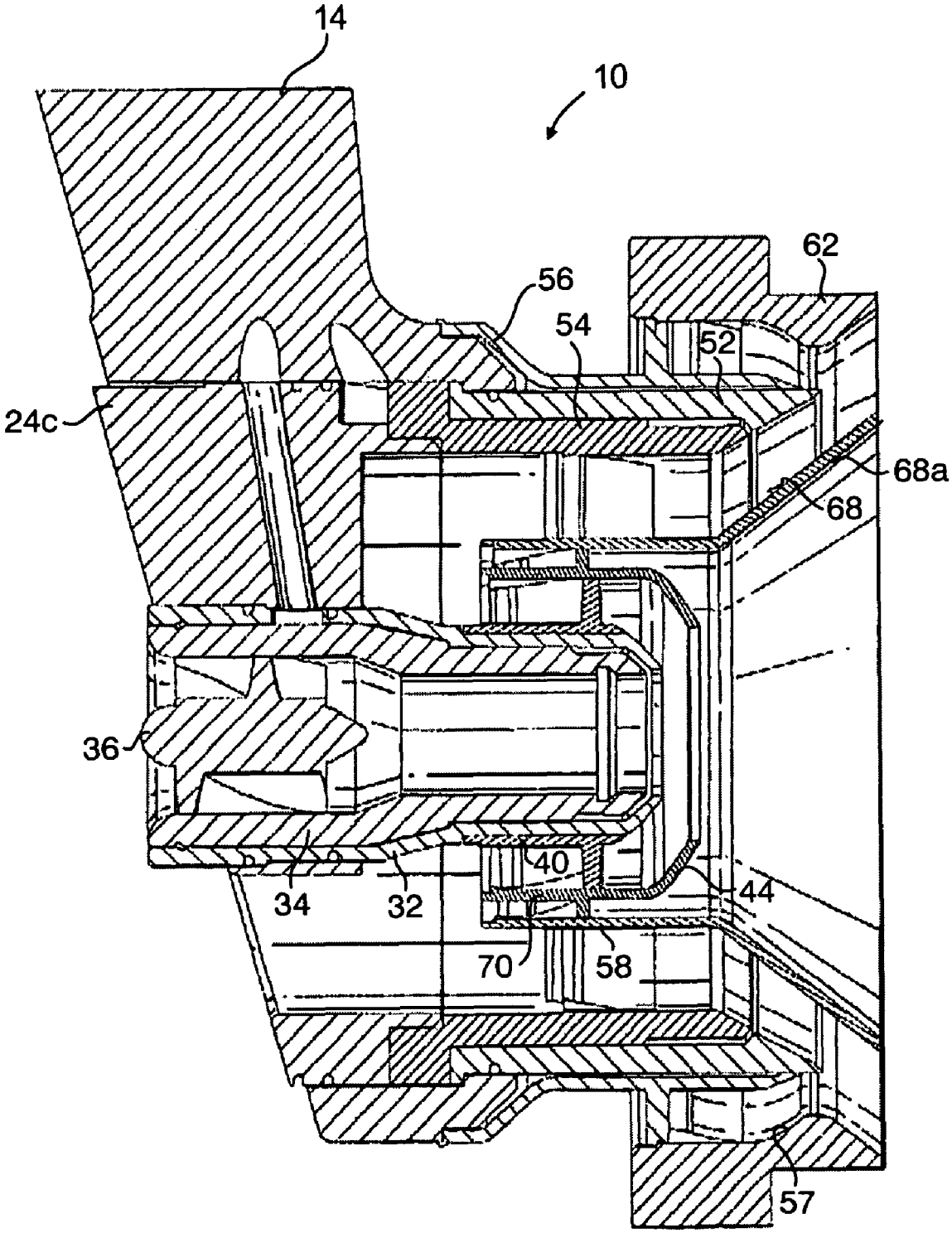
FIG. 4A is a side elevational view of the lean direct injection fuel nozzle similar to FIG. 4, wherein the terminal edge of the inner wall of the main inner air passage is coincident with the terminal edge of the outer air cap.

As illustrated in FIG. 4, the terminal edge of inner wall 68 extends beyond the terminal edge of the main fuel prefilmer, and indeed, beyond the terminal edge of the outer air cap 62. However, it is envisioned and well within the scope of the subject disclosure that the terminal edge of inner wall 68 of the main inner air passage can extend to the leading edge of the fuel prefilmer (see e.g., FIG. 9). Alternatively, the terminal edge of the inner wall 68 of the main inner air passage 66 can be coincident with the terminal edge of the outer air cap 62, as shown in FIG. 4A.

To the extent that it is desirable or otherwise advantageous to construct a fuel nozzle of the type disclosed herein, which has a series nested coaxially arranged structures, by orderly inserting each of the components into one another from an upstream side of the nozzle, rather than from a downstream side of the nozzle, to ensure mechanical capture of each component, those skilled in the art will readily appreciate that the extent of the inner wall 68 will be limited by the largest structural diameter that is able to be insert into the nozzle assembly from an upstream side. In contrast, where the design of the nozzle would allow for assembly by inserting components from a downstream side of the nozzle, rather than from an upstream side of the nozzle, the inner wall 68 can readily extend beyond the main outer air cap, since the diameter of the structure would not be a limiting factor.

The conically extending inner wall 68 of the main inner air passage 66 is configured to mechanically separate the main combustion zone from the pilot combustion zone. The large extent of the mechanical separation between the inboard pilot combustion zone and the outboard main combustion zone, along with the enhanced atomization and mixing afforded by the conically extending inner wall 68 of the main air-blast atomizer, allows sufficient time for the main fuel and air to thoroughly mix prior to reaching the ignition source from the pilot combustion zone.

Preferably, the intermediate air swirler 70 includes a set of swirl vanes 72 oriented at an angle sufficient to ensure that the cooling air flowing through intermediate air circuit 75 remains attached to the diverging downstream surface 68*a* of the radially inner wall 68 of the main inner air passage 66. Accordingly, the swirl vanes 72 of intermediate air swirler 70 are oriented at an angle of between about 30° to about 60° relative to a central axis of nozzle body 12. Preferably, the vane angle of swirl vanes 72 is about 45° relative to a central axis of nozzle body 12.

Swirl vanes 72 can be oriented or otherwise configured to impart swirl in either a clockwise direction or a counter-clockwise direction relative to a central axis of the nozzle body 12. The swirl direction of the intermediate air swirler 70 can be either co-rotational or counter-rotational with respect to the swirl direction of the main inner air swirler 58.

The conically expanding inner wall 68 of the main inner passage 66 confines the swirling compressor discharge air across the fuel prefilmer, and is designed to provide full coverage as well as accelerated air-flow across the fuel prefilmer for enhanced atomization and rapid mixing of the fuel and air, as illustrated in FIG. 6. The accelerated air flow across the main fuel prefilmer results from a pressure-drop taken at this location caused by the confinement of the main inner air passage 66 of the main fuel atomizer. Because this inner wall of the main atomizer provides full coverage of the main fuel prefilmer, it also reduces the likelihood of combustion pressure fluctuations from feeding upstream through both the inner main air passage 66 as well as through the main liquid fuel circuit 53. The benefits of the nozzle effect achieved by the conically expanding inner wall 68 of the main inner air passage 66 occur however, at the expense of reducing the effective flow area of the main inner air circuit.

Figure 4B:
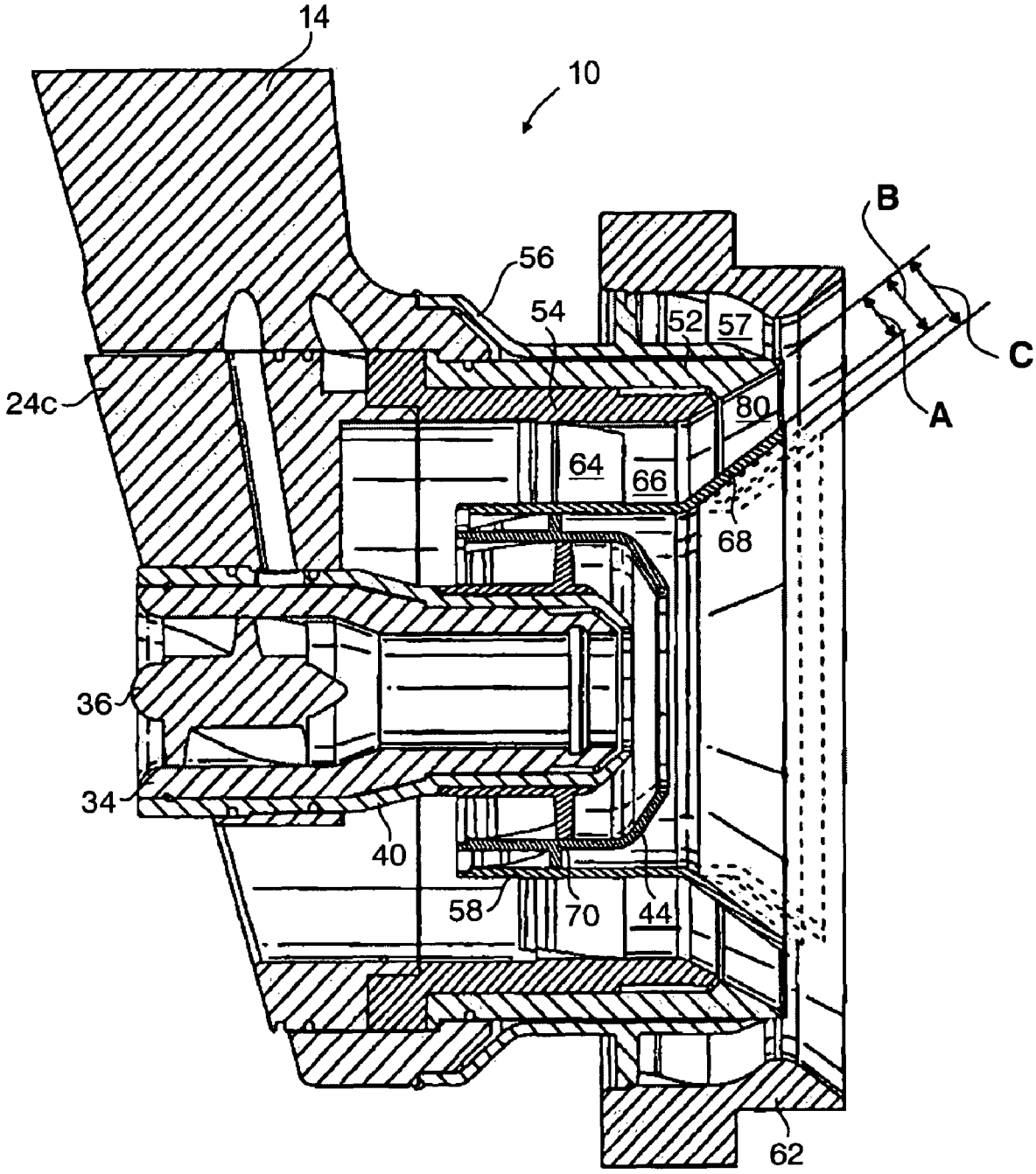
FIG. 4B is a side elevational view of another embodiment of the lean direct injection fuel nozzle of FIGS. 2 and 3, in cross-section, showing variations in the gap size of the conically expanding downstream section of the main inner air passage.

Referring now to FIG. 4B, the main inner air passage 66 defines an annular gap 80 that is bounded by the main fuel prefilmer 52, 54 and the conically expanding inner wall 68 described above. This annular gap has a given width and a commensurate effective flow area. It has been determined by experimentation and analysis that if the size of this annular gap is increased sufficiently, the amount of air flowing through the main inner air circuit 66 of nozzle body 12 will increase beyond a baseline level.

It has been determined that in certain instances, the size of the annular gap 80 can be increased to the extent that the proportional airflow through the main inner air circuit 66 of nozzle body 12 increases above 30% if no conically expanding inner wall 68 was present. As a consequence of this effect, the relative amounts of airflow between the main inner air circuit 66 and the main outer air circuit 57, as well as the amount of airflow through the main inner air circuit 66, can be effectively managed. Such control of over localized airflow permits management of the local fuel/air ratio for the main combustion zone, and allows for aerodynamic control over the separation of the pilot and main combustion zones. This is beneficial to reducing NOx pollutant emissions.

The flow through the main inner air passage 66 is controlled by the minimum area of the flow-path and the pressure-drop across the passage, from inlet to exit. When the size of the annular gap 80 is increased sufficiently, then the minimum area of the main inner air passage 66 occurs at the main inner air swirler 64, with an increase in flow-path area from the exit of the main inner air swirler 64 to the exit of the main inner air passage 66. If the portion of the main inner air passage 66 which is downstream of the main inner air swirler 64 has an ever-increasing flow-path area, then, for attached subsonic flows, the pressure will have to increase from the minimum area location (i.e., at the exit of the main inner swirler 64) to the exit location of the main inner air passage 66.

With a fixed pressure drop from the upstream inlet of the main inner air passage 66 to the downstream exit of the main inner air passage 66, the pressure at the exit of the main inner air swirler 64 will have to actually drop below the downstream combustor pressure. The result is a localized increase in pressure-drop across the minimum area location (i.e., the main inner air swirler 64), and a concomitant increase in the mass flow rate. Therefore, with a properly sized annular gap 80 and the airflow attached to the walls of the main inner air passage 66, the main inner air passage 66 can flow more air than without the conically expanding inner wall 68. This mode of operation for the main inner air passage 66 is called the diffuser-mode as opposed to the previously described nozzle-mode.

Since the mass flow rate through the main inner air passage 66 has increased in the diffuser-mode, the flow velocity through the main inner air swirler 64 will also increase. As the flow path area of the main inner air passage 66 downstream of the main inner air swirler 64 increases, the flow velocity will decrease. However, the average flow velocity across the main fuel prefilmer 52, 54 will remain relatively constant within a range of annular gap 80 sizes, so long as the flow remains attached to the walls. It has been shown that when the annular gap size is selected so that the main inner air circuit is operating in a diffuser-mode, combustion instability is minimized and nozzle body 12 will exhibit good altitude relight and low NOx.

As shown in FIG. 4B, by extending the tip of the conically expanding inner wall 68 of the main inner air passage 66 axially downstream, the size of the annular gap 80 increases. FIG. 4B shows three different annular gap sizes, A, B and C, established by moving the conically expanding inner wall 68 incrementally downstream. Table 1.0 below contains experimental data that illustrates an increase in the amount of airflow through the main inner air circuit 66 as the size of annular gap 80 is increased incrementally. In this instance, a 35° 3-lead swirler was employed in the main inner air circuit, upstream from the annular gap 80, with the atmospheric conditions for the test set at a pressure ratio of 1.050. The increased airflow is taken relative to a baseline level that corresponds to the annular gap being wide open, which, would mean that the conically expanding wall 68 would not be not present.

TABLE 1.0

| Annular Gap | % Difference from Nominal |
|---|---|
| Wide Open | 0% (Nom.) |
| A | 6.4% |
| B | 26.7% |
| C | 32.8% |

Figure 7:
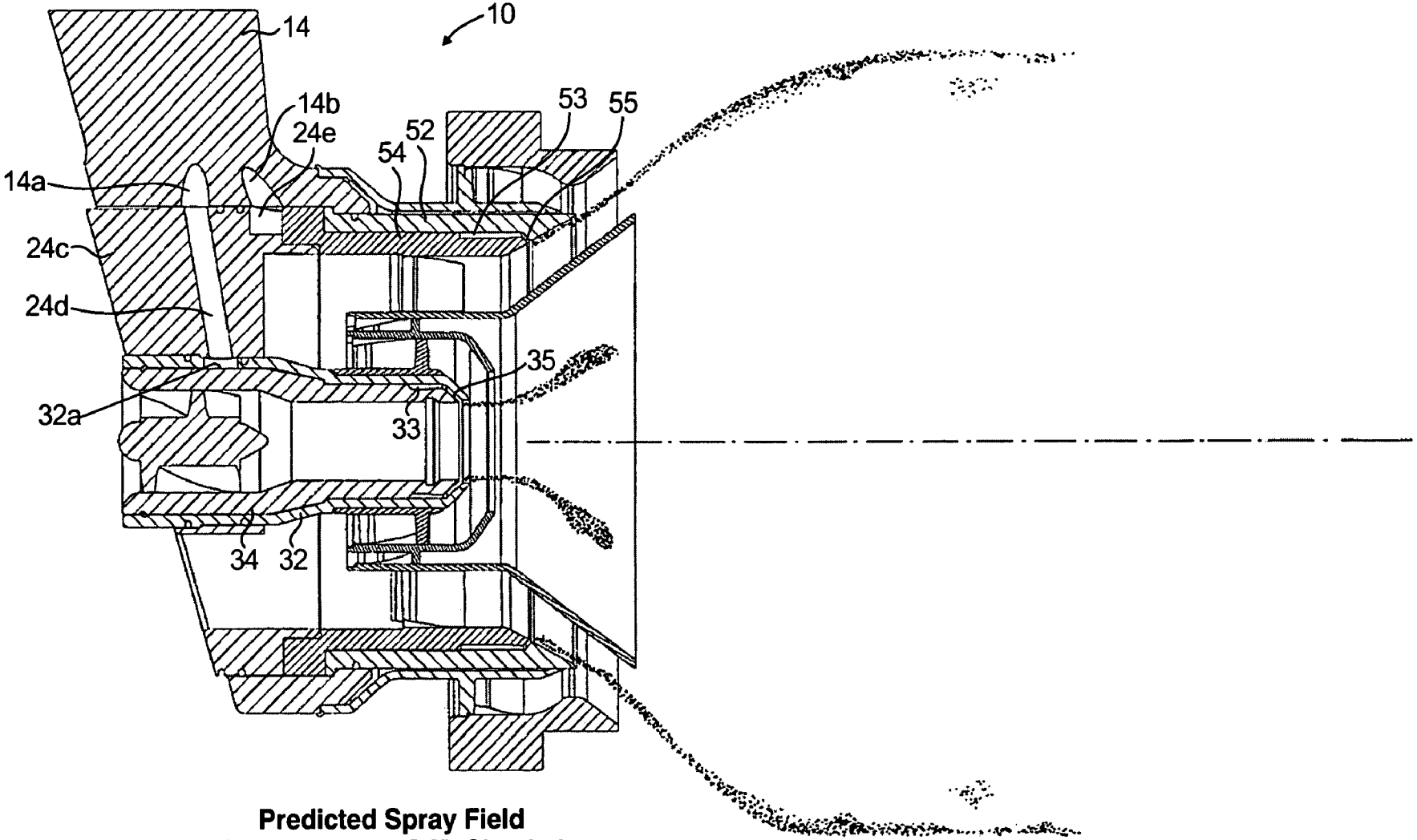
FIG. 7 is a cross-sectional view of the lean direct injection nozzle, as shown in FIG. 4, illustrating the predicted fuel spray field of the main and pilot fuel delivery systems during high power operation.
Figure 8:
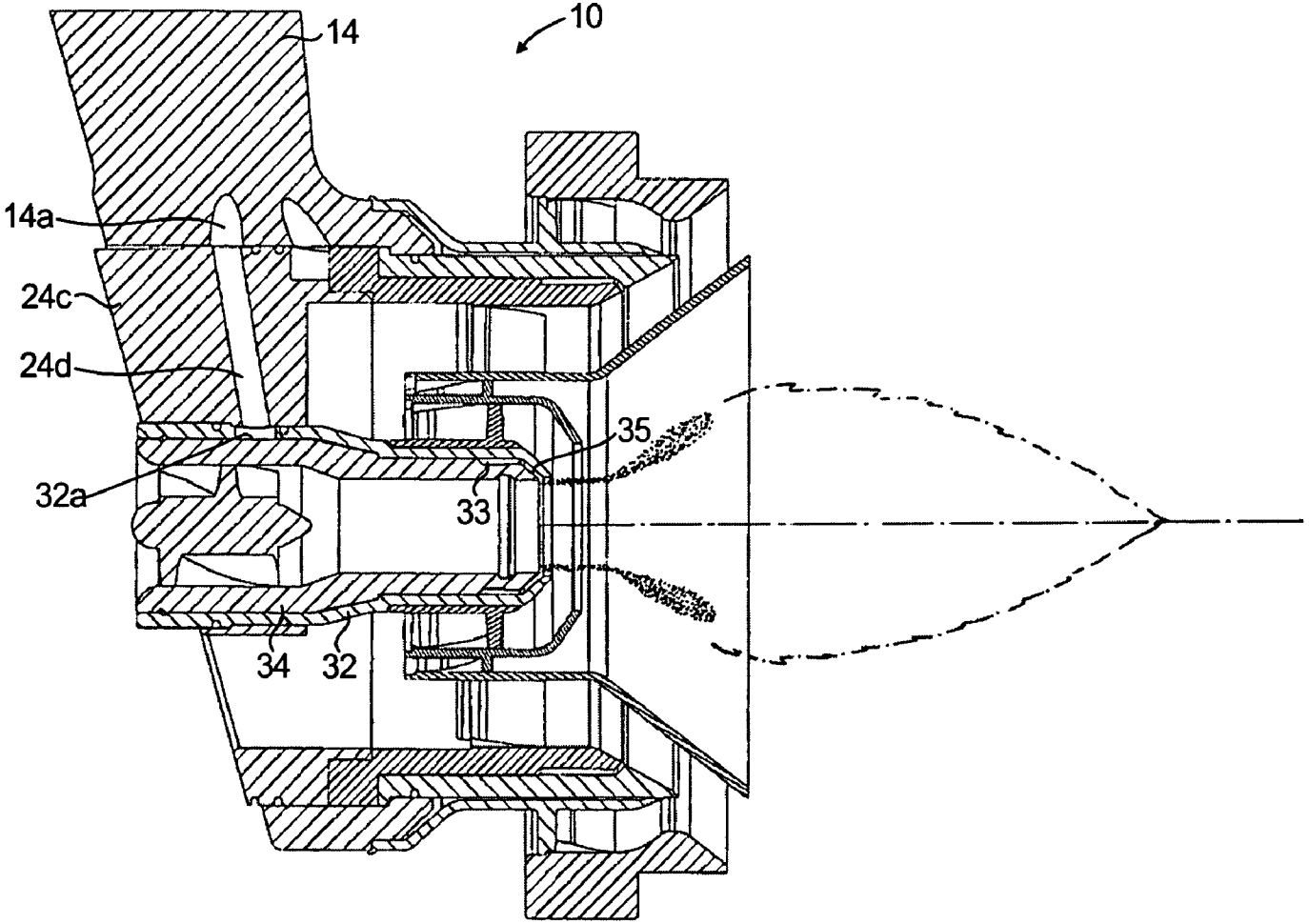
FIG. 8 is a cross-sectional view of the lean direct injection nozzle, as shown in FIG. 4, illustrating the predicted fuel spray field of the pilot fuel delivery system during low power operation.

Referring to FIG. 5, in use, for low power operations, only the pilot fuel delivery system of nozzle body 12 is operational. The predicted fuel spray field issuing from the pilot fuel circuit during low power operation is illustrated in FIG. 8. At higher power operations, both the pilot and main fuel delivery systems are operational, as shown in FIG. 6. The predicted fuel spray field issuing from the main and pilot fuel circuits during high power operation is illustrated in FIG. 7. The pilot fuel delivery system is designed to have good flame stability, low smoke and low emissions. The main fuel delivery system is designed to allow for good fuel/air mixing producing a lean-burning flame for low emissions.

Figure 6A:
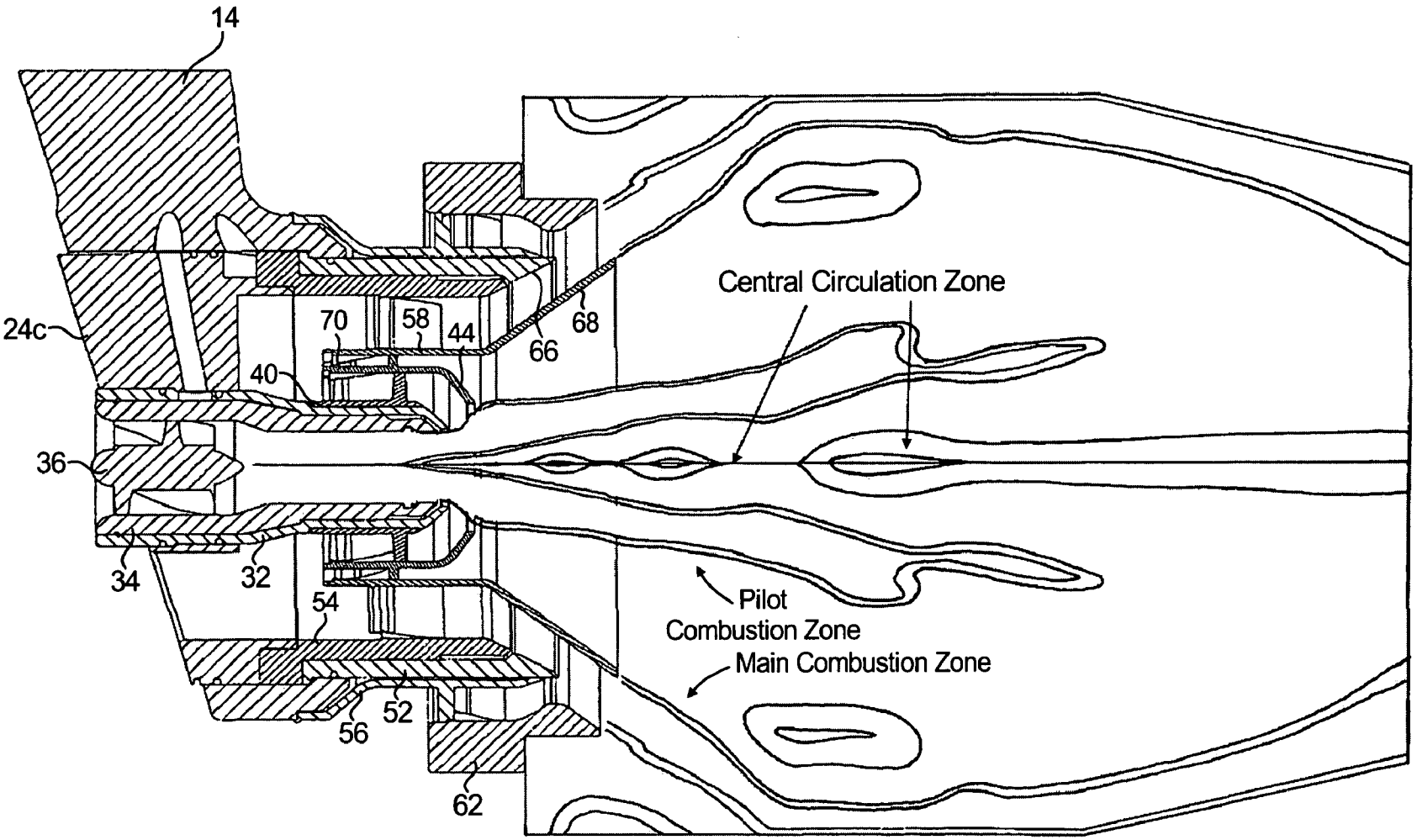
FIG. 6A is an illustration of the flow field structure, identified by axial velocity contours, issuing from the lean direct injection nozzle of FIG. 4 under a certain set of conditions, wherein a weak central recirculation zone is supported within the pilot combustion zone.

The flow field structure issuing from the lean direct injection nozzle of FIG. 4, which results from the nozzle geometry, e.g., the swirl vane angles, orifice sizing and flow path, is shown in FIG. 6A, identified by mean axial velocity contours. As illustrated, the on or near-axis pilot combustion zone is mechanically and aerodynamically separated from the outboard main combustion zone by the conically extending inner wall 68 of the main inner air passage 66, in conjunction with the motive effect of the main inner air flow and the cushioning effect of the intermediate cooling air. Those skilled in the art will readily appreciate that under a certain set of conditions, for example, when the swirl vanes of the inner and outer pilot air passages are set at appropriate angles and the orifice of the pilot air cap is appropriately sized, the LDI nozzle of the subject invention may produce a relatively narrow, generally weak central recirculation zone, that is supported within the pilot combustion zone, as illustrated in FIG. 6A.

Figure 9:
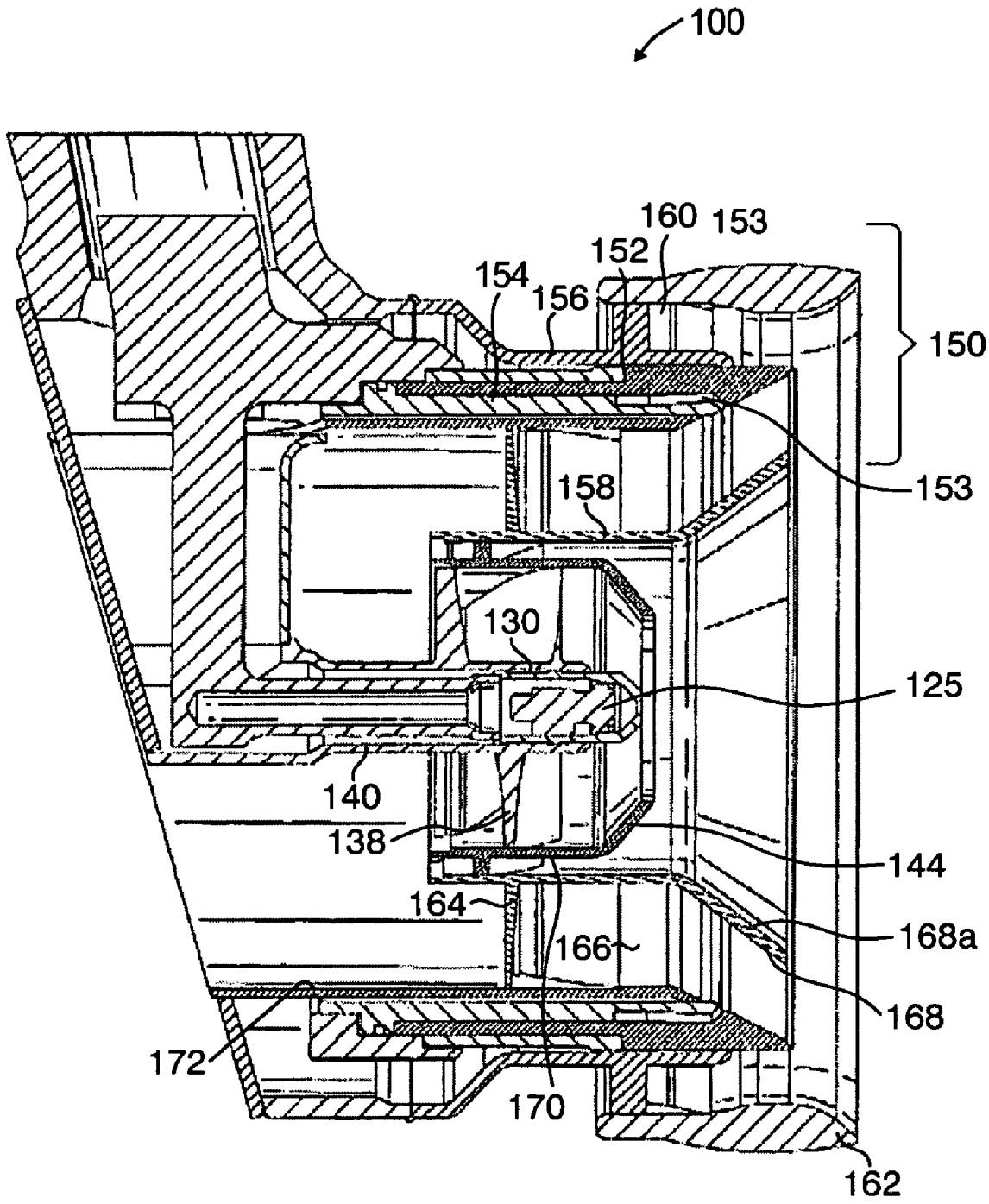
FIG. 9 is a side elevational view, in cross-section, of another lean direct injection nozzle constructed in accordance with a preferred embodiment of the subject invention, which includes a pre-filming air-blast type main fuel delivery system and a simplex air-blast type pilot fuel delivery system.
Figure 10:
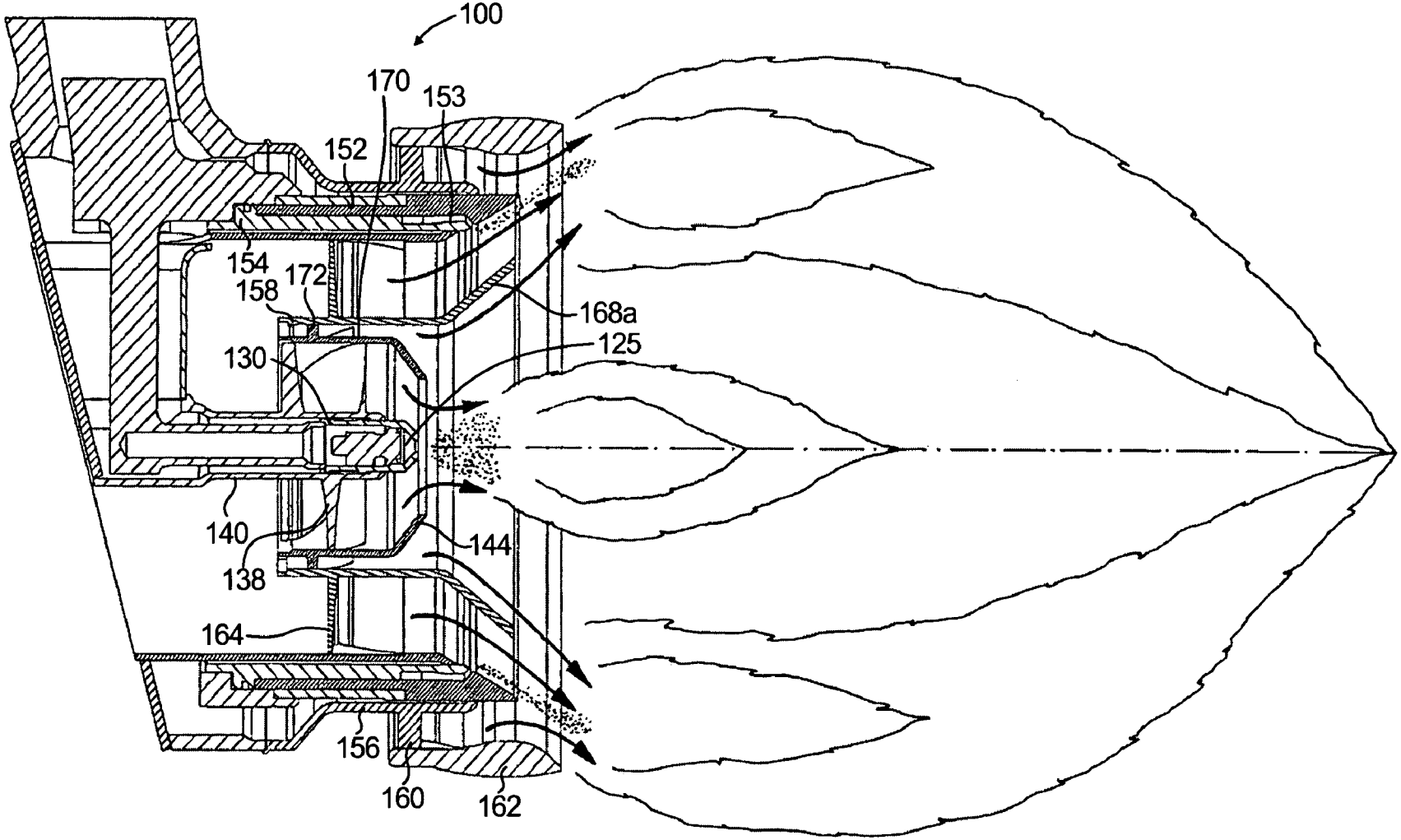
FIG. 10 is a cross-sectional view of the lean direct injection nozzle as shown in FIG. 9, illustrating the flow paths for air and fuel within the main fuel delivery system and the pilot fuel delivery system of the nozzle during high power operation.

Turning now to FIGS. 9 and 10, there is illustrated another lean direct fuel injector constructed in accordance with a preferred embodiment of the subject invention and designated generally by reference numeral 100. Fuel injector 100 is similar in some respects to fuel injector 10 in that it includes a main fuel delivery system in the form of a prefilming airblast atomizer.

Fuel injector 100 differs from fuel injector 10 in that the pilot fuel delivery system is of a simplex air-blast type, rather than a prefilming air-blast type. Accordingly, as described in more detail below, the pilot fuel delivery system includes a pressure swirl atomizer 125, a pilot outer air swirler 140 and a pilot fuel swirler 130 located radially inward of the pilot outer air swirler 140. A simplex airblast fuel injection system for the atomization of fuel is disclosed in commonly assigned U.S. Pat. No. 5,224,333 to Bretz et al. the disclosure of which is herein incorporated by reference in its entirety.

Referring to FIGS. 9 and 10, the main fuel delivery system of fuel injector 100 includes a main fuel swirler 150 that includes a radially outer swirler section 152 and a radially inner swirler section 154. A main fuel path 153 is formed between the outer swirler section 52 and the inner swirler section 154 of the main fuel swirler 150. Fuel from the main fuel swirler 150 interacts with inner and outer air streams emanating from a main radially outer air swirler 156 and a main radially inner air swirler 158. The main outer air swirler 156 has a set of circumferentially spaced apart swirl vanes 160 bounded by an outer air cap 162, and the main inner air swirler 158 has a set of circumferentially spaced apart swirl vanes 164.

The main inner air passage 166 has an outboard wall 165 that serves as a heat shield for the main fuel swirler and has a conically extending inner wall 168, which defines a diverging downstream surface 168*a*. The diverging downstream surface 168*a* of the inner wall 168 of the main inner air passage 166 is exposed to high-temperature combustion products during operation, which could lead to excessive thermal distress.

In accordance with the subject invention, an intermediate air swirler 170 with a set of circumferentially spaced apart swirl vanes 172 is located between the main inner air swirler 158 of the main fuel delivery system and the pilot outer air swirler 140 of the pilot fuel delivery system. As in fuel injector 10, the intermediate air swirler 170 provides a film of cooling air along the downstream surface 168*a* of the inner wall 168 of the main inner air passage 166 to shield downstream surface 168*a* from thermal damage and distress.

As noted above, the pilot fuel delivery system of fuel injector 100 is a simplex air-blast type atomizer, which includes an on axis pressure swirl atomizer 125. Atomizer 125 directs pressurized combustor discharge air toward the swirling fuel issuing from the pilot fuel swirler 130, as shown in FIG. 10. The pilot outer air swirler 140 is located outboard from the pilot fuel swirler 130 and includes a set of circumferentially spaced apart swirl vanes 138 oriented or otherwise configured to impart swirl to the combustor discharge air flowing through the pilot outer air circuit. The pilot outer air flow is directed radially inwardly by the converging wall of the pilot air cap 144, so that it acts upon the liquid fuel issuing from the pilot fuel swirler 130.

Although the fuel delivery system of the subject invention has been described with respect to preferred embodiments, those skilled in the art will readily appreciate that changes and modifications may be made thereto without departing from the spirit and scope of the subject invention as defined by the appended claims.

What is claimed is:

1. A lean direct injection fuel nozzle for a gas turbine comprising:

a) a radially outer main fuel delivery system including a main fuel path, and a main inner air swirler defined in part by a main inner air passage having a radially inner wall with a diverging, conically expanding downstream surface, wherein the main fuel path has a downstream exit located in a conically expanding part of the main inner air passage;

b) an intermediate air swirler radially inward of the main inner air swirler for providing a cooling air flow along the conically expanding downstream surface of the radially inner wall of the main inner air passage; and c) a radially inner pilot fuel delivery system radially inward of the intermediate air swirler and including a converging pilot air cap terminating upstream from the conically expanding downstream surface of the main inner air passage for confining an outer air stream of the pilot fuel delivery system passing inboard of the pilot air cap, wherein a terminal edge of the converging pilot air cap is exposed to the outer air steam of the pilot fuel delivery system.

2. A lean direct injection fuel nozzle as recited in claim 1, wherein the main fuel delivery system is of a pre-filming air-blast type and includes a main fuel swirler radially outward of the main inner air swirler, a main outer air swirler radially outward of the main fuel swirler, and an outer air cap radially outward of the main outer air swirler.

3. A lean direct injection fuel nozzle as recited in claim 2, wherein a terminal edge of the radially inner wall of the main inner air passage is located downstream from a terminal edge of the outer air cap.

4. A lean direct injection fuel nozzle as recited in claim 2, wherein a terminal edge of the radially inner wall of the main inner air passage is located upstream from a terminal edge of the outer air cap.

5. A lean direct injection fuel nozzle as recited in claim 2, wherein the main inner air swirler includes swirl vanes oriented at angle of between about 20° to about 50° relative to a central axis of the fuel nozzle.

6. A lean direct injection fuel nozzle as recited in claim 5, wherein the swirl vanes of the main inner air swirler are oriented to impart swirl in one of a clockwise direction and a counter-clockwise direction relative to a central axis of the fuel nozzle.

7. A lean direct injection fuel nozzle as recited in claim 2, wherein the main outer air swirler includes swirl vanes oriented at angle of between about 45° to about 60° relative to a central axis of the fuel nozzle.

8. A lean direct injection fuel nozzle as recited in claim 7, wherein the swirl vanes of the main outer air swirler are oriented to impart swirl in one of a clockwise direction and a counter-clockwise direction relative to a central axis of the fuel nozzle.

9. A lean direct injection fuel nozzle as recited in claim 7, wherein the swirl vanes of the main outer air swirler are configured as axial swirl vanes.

10. A lean direct injection fuel nozzle as recited in claim 2, wherein a swirl direction of the main outer air swirler is co-rotational with respect to a swirl direction of the main inner air swirler.

11. A lean direct injection fuel nozzle as recited in claim 2, wherein a swirl direction of the main outer air swirler is counter-rotational with respect to a swirl direction of the main inner air swirler.

12. A lean direct injection fuel nozzle as recited in claim 1, wherein the pilot fuel delivery system is of a simplex air-blast type, which includes a pressure swirl atomizer.

13. A lean direct injection fuel nozzle as recited in claim 12, wherein the pilot fuel delivery system includes a pilot outer air swirler, and a pilot fuel swirler radially inward of the pilot outer air swirler.

14. A lean direct injection fuel nozzle as recited in claim 1, wherein the pilot fuel delivery system is of a pre-filming air-blast type.

15. A lean direct injection fuel nozzle as recited in claim 14, wherein the pilot fuel delivery system includes a pilot outer air swirler, a pilot fuel swirler radially inward of the pilot outer air swirler, and a pilot inner air swirler extending along a central axis of the fuel nozzle.

16. A lean direct injection fuel nozzle as recited in claim 15, wherein the pilot inner air swirler includes a set of swirl vanes oriented to impart swirl in one of a clockwise and a counter-clockwise direction relative to a central axis of the fuel nozzle.

17. A lean direct injection fuel nozzle as recited in claim 16, wherein the pilot outer air swirler includes a set of swirl vanes oriented to impart swirl in one of a clockwise and a counter-clockwise direction relative to a central axis of the fuel nozzle.

18. A lean direct injection fuel nozzle as recited in claim 17, wherein the swirl vanes of the pilot outer air swirler are configured as axial swirl vanes.

19. A lean direct injection fuel nozzle as recited in claim 17, wherein a swirl direction of the pilot outer air swirler is co-rotational with respect to a swirl direction of the pilot inner air swirler.

20. A lean direct injection fuel nozzle as recited in claim 17, wherein a swirl direction of the pilot outer air swirler is counter-rotational with respect to a swirl direction of the pilot inner air swirler.

21. A lean direct injection fuel nozzle as recited in claim 1, wherein the intermediate air swirler includes a set of swirl vanes oriented at an angle sufficient to ensure that the cooling air remains attached to the diverging, conically expanding downstream surface of the radially inner wall of the main inner air passage.

22. A lean direct injection fuel nozzle as recited in claim 21, wherein the intermediate air swirler includes a set of swirl vanes oriented at an angle of between about 35° to about 60° relative to a central axis of the fuel nozzle.

23. A lean direct injection fuel nozzle as recited in claim 21, wherein the swirl vanes of the intermediate air swirler are oriented to impart swirl in one of a clockwise direction and a counter-clockwise direction relative to a central axis of the fuel nozzle.

24. A lean direct injection fuel nozzle as recited in claim 23, wherein a swirl direction of the intermediate air swirler is co-rotational with respect to a swirl direction of the main inner air swirler.

25. A lean direct injection fuel nozzle as recited in claim 23, wherein a swirl direction of the intermediate air swirler is counter-rotational with respect to a swirl direction of the main inner air swirler.

26. A lean direct injection fuel nozzle for a gas turbine comprising:

a) a radially outer main fuel delivery system having an outer air cap and including:

i) a main outer air swirler radially inward of the outer air cap;

ii) a main fuel swirler radially inward of the main outer air swirler; and iii) a main inner air swirler radially inward of the main fuel swirler, and defined in part by a main inner air passage having a radially inner wall with a diverging, conically expanding downstream surface, wherein the main fuel swirler includes a downstream exit located in a conically expanding part of the main inner air passage;

b) an intermediate air swirler radially inward of the main inner air swirler for providing a cooling air flow along the conically expanding downstream surface of the radially inner wall of the main inner air passage; and c) a radially inner pilot fuel delivery system having a converging pilot air cap radially inward of the intermediate air swirler for confining an outer air stream of the pilot fuel delivery system passing inboard of the pilot air cap, wherein the pilot air cap terminates upstream from the conically expanding downstream surface of the main inner air passage and a terminal edge of the converging pilot air cap is exposed to the outer air stream of the pilot fuel delivery system.

27. A lean direct injection fuel nozzle as recited in claim 26, wherein the pilot fuel delivery system is of a simplex air-blast type, which includes a pressure swirl atomizer.

28. A lean direct injection fuel nozzle as recited in claim 27, wherein the pilot fuel delivery system includes a pilot outer air swirler, and a pilot fuel swirler radially inward of the pilot outer air swirler.

29. A lean direct injection fuel nozzle as recited in claim 26, wherein the pilot fuel delivery system is of a pre-filming air-blast type.

30. A lean direct injection fuel nozzle as recited in claim 29, wherein the pilot fuel delivery system includes a pilot outer air swirler, a pilot fuel swirler radially inward of the pilot outer air swirler, and a pilot inner air swirler extending along a central axis of the fuel nozzle.

31. A lean direct injection fuel nozzle as recited in claim 26, wherein a terminal edge of the radially inner wall of the main inner air passage is located downstream from a terminal edge of the outer air cap.

32. A lean direct injection fuel nozzle as recited in claim 26, wherein a terminal edge of the radially inner wall of the main inner air passage is located upstream from a terminal edge of the outer air cap.

33. A lean direct injection fuel nozzle as recited in claim 26, wherein a terminal edge of the radially inner wall of the main inner air passage is coincident with a terminal edge of the outer air cap.

* * * * *

UNITED STATES PATENT AND TRADEMARK OFFICE

CERTIFICATE OF CORRECTION

PATENT NO. : 7,779,636 B2
APPLICATION NO. : 11/399634
DATED : August 24, 2010
INVENTOR(S) : Philip Buelow et al.

It is certified that error appears in the above-identified patent and that said Letters Patent is hereby corrected as shown below:

On the title page item (73), should read as follows:

--Assignees: Delavan Inc., West Des Moines, IA (US)
Rolls-Royce PLC, London, England--

Column 13, line 41, "steam" should read --stream--.

Signed and Sealed this
Nineteenth Day of July, 2011

David J. Kappos

David J. Kappos
*Director of the United States Patent and Trademark Office*